US008710725B2

(12) United States Patent
Yoshida et al.

(10) Patent No.: US 8,710,725 B2
(45) Date of Patent: Apr. 29, 2014

(54) SPARK PLUG

(75) Inventors: Haruki Yoshida, Tajimi (JP); Toshitaka Honda, Aichi (JP)

(73) Assignee: NGK Spark Plug Co. Ltd. (JP)

( * ) Notice: Subject to any disclaimer, the term of this patent is extended or adjusted under 35 U.S.C. 154(b) by 0 days.

(21) Appl. No.: 13/876,497

(22) PCT Filed: Sep. 27, 2011

(86) PCT No.: PCT/JP2011/005431

§ 371 (c)(1),
(2), (4) Date: Mar. 28, 2013

(87) PCT Pub. No.: WO2012/042852

PCT Pub. Date: Apr. 5, 2012

(65) Prior Publication Data

US 2013/0187531 A1 Jul. 25, 2013

(30) Foreign Application Priority Data

Oct. 1, 2010 (JP) ..... 2010-224263

(51) Int. Cl.
*H01T 13/02* (2006.01)

(52) U.S. Cl.
USPC ..... 313/143

(58) Field of Classification Search
CPC ..... H01T 13/20; H01T 13/02; H01T 13/00; H01T 21/02; H01T 13/34; H01T 13/41; H01T 13/54; H01T 13/14; H01T 13/38; H01T 13/32; F02N 99/004
USPC ..... 313/135–138, 141, 143–145; 123/169 R, 169 EL
See application file for complete search history.

(56) References Cited

U.S. PATENT DOCUMENTS

| | | | | |
|---|---|---|---|---|
| 6,680,561 | B2 | 1/2004 | Yamaguchi et al. | H01T 13/20 |
| 2010/0264823 | A1 | 10/2010 | Suzuki et al. | 315/71 |

FOREIGN PATENT DOCUMENTS

| | | | |
|---|---|---|---|
| JP | 58-111286 | 7/1983 | H01T 13/20 |
| JP | 2003-142224 | 5/2003 | H01T 21/02 |
| JP | 2009-245716 | 10/2009 | H01T 13/20 |

OTHER PUBLICATIONS

Form PCT/ISA/210—Int'l Search Report (from corresponding Int'l Patent App. No. PCT/JP2011/005431—2 pages.

*Primary Examiner* — Donald Raleigh
(74) *Attorney, Agent, or Firm* — Kusner & Jaffe

(57) ABSTRACT

A spark plug having improved load life performance and fixing strength of a metallic terminal to an insulator, and which reduces the incidence of breakage of the insulator when the metallic terminal is inserted into the axial hole of the insulator. The spark plug of the present invention is characterized in that the distance ((B−A)/2) between the forward end portion of the metallic terminal and the wall surface of an intermediate diameter portion of the axial hole of the insulator falls within a range of 0.02 mm to 0.2 mm, the shrinkage amount (D−C) of a connecting portion falls within a range of 6 mm to 27 mm, and the Vickers hardness of the metallic terminal at ordinary temperature falls within a range of 100 Hv to 430 Hv.

7 Claims, 3 Drawing Sheets

SPARK PLUG

FIELD OF THE INVENTION

The present invention relates to a spark plug used for igniting an internal combustion engine, and more particularly to a spark plug having a resistor incorporated therein.

BACKGROUND OF THE INVENTION

In general, a spark plug used for igniting an internal combustion engine such an automotive engine includes a tubular metallic shell; a tubular insulator disposed in the bore of the metallic shell; a center electrode disposed in a forward end portion of the axial hole of the insulator; a metallic terminal disposed in a rear end portion of the axial hole; and a ground electrode. One end of the ground electrode is joined to a forward end of the metallic shell and the other end faces the center electrode so as to form a spark discharge gap. There has been known a spark plug including a resistor which is disposed in the axial hole between the center electrode and the metallic terminal so as to prevent generation of radio noise.

Recent internal combustion engines for automobiles or the like have been required to produce a higher power and to operate with a higher efficiency, and development of a spark plug of a reduced size has been demanded in order to allow free design of engines and a reduction in the size of engines themselves. In order to reduce the size of a spark plug, the diameter of the bore of the insulator must be decreased. However, in the case of a spark plug designed in a conventional manner, decreasing the diameter of the insulator may reduce load life performance and decrease the fixing strength of the metallic terminal to the insulator. Also, in some cases, the insulator breaks during the step of inserting the metallic terminal into the bore or axial hole, which is one of the steps of manufacturing spark plugs, whereby defective incidence increases.

A spark plug which can solve such a problem is disclosed in, for example, Japanese Patent Application Laid-Open (kokai) No. 2009-245716. In claim 1 of Japanese Patent Application Laid-Open (kokai) No. 2009-245716, there is recited a "spark plug characterized in that the diameter D of the electrically conductive glass seal layer is 3.3 mm or less, and the joint surface between the electrically conductive glass seal layer and the resistor is formed to have a curved shape." Japanese Patent Application Laid-Open (kokai) No. 2009-245716 states that the invention can provide a "spark plug which is enhanced in adhesion between the resistor and the electrically conductive glass seal layer, which is excellent in vibration resistance and load life performance of the resistor, and which has a reduced diameter" (see paragraph 0012).

SUMMARY OF THE INVENTION

The present invention provides a spark plug which is excellent in load life performance and fixing strength of a metallic terminal to an insulator, and which reduces the incidence of defectives produced as a result of breakage of the insulator when the metallic terminal is inserted into the axial hole of the insulator.

In accordance with the present invention, there is provided a spark plug comprising:

an insulator having an axial hole extending in a direction of an axis;

a center electrode held at one end of the axial hole;

a metallic terminal held at the other end of the axial hole; and a connecting portion which electrically connects the center electrode and the metallic terminal within the axial hole; wherein the metallic terminal has a first constituent portion exposed from the axial hole, and a second constituent portion accommodated in the axial hole;

the side of the metallic terminal where the first constituent portion is provided is defined as the rear end side with respect to the direction of the axis O;

the axial hole has an intermediate diameter portion in which a forward end portion of the second constituent portion is disposed; and when a diameter of the forward end portion of the second constituent portion is referred to as a forward end portion diameter (A), a diameter of the intermediate diameter portion is referred to as an intermediate diameter portion diameter (B), a length from the rear end of the center electrode to the rear end of a connecting member constituting the connecting portion is referred to as a charging length (D), and a length from the rear end of the center electrode to the forward end of the second constituent portion is referred to as a connecting portion length (C), a distance ((B−A)/2) between the forward end portion of the second constituent portion and the wall surface of the intermediate diameter portion falls within a range of 0.02 mm to 0.2 mm, a shrinkage amount (D−C) falls within a range of 6 mm to 27 mm, and the second constituent portion has a Vickers hardness of 100 Hv to 430 Hv at ordinary temperature.

In accordance with another aspect of the present invention, there is provided a spark plug as described above, wherein the second constituent portion has a smallest diameter portion, which is smallest in diameter, at a position other than the forward end portion of the second constituent portion, and a ratio (E/A) of a smallest diameter portion diameter (E), which is the diameter of the smallest diameter portion, to the forward end portion diameter (A), falls within a range of 0.85 to 1.16.

In accordance with another aspect of the present invention, there is provided a spark plug as described above, wherein the intermediate diameter portion diameter (B) is equal to or less than 3.2 mm, and the following relational expressions (i) to (iv) are satisfied, where X represents the above-described distance ((B−A)/2), and Y represents the above-described ratio (E/A):

$$X \leq 0.19, \quad \text{(i)}$$

$$Y \geq X + 0.8, \quad \text{(ii)}$$

$$Y \geq 0.85, \text{ and} \quad \text{(iii)}$$

$$Y \leq 1.06X + 0.96. \quad \text{(iv)}$$

In accordance with another aspect of the present invention, there is provided a spark plug as described above, wherein the ratio (E/A) falls within a range of 1.00 to 1.16.

In accordance with another aspect of the present invention, there is provided a spark plug as described above, wherein the intermediate diameter portion diameter (B) is 2.9 mm or less.

In accordance with another aspect of the present invention, there is provided a spark plug as described above, wherein the Vickers hardness of the second constituent portion at ordinary temperature falls within a range of 150 Hv to 350 Hv.

In accordance with another aspect of the present invention, there is provided a spark plug as described above, wherein the second constituent portion has a fixing portion having an uneven surface, and the fixing portion has a length of 3 mm to 25 mm in the direction of the axis O.

In the spark plug of the present invention, the above-mentioned distance ((B−A)/2), the above-mentioned shrinkage amount (D−C), and the above-mentioned Vickers hardness of the second constituent portion at ordinary temperature fall within predetermined ranges. Therefore, there can be provided a spark plug which is excellent in load life performance and the fixing strength of the metallic terminal to the insulator. Further, such a spark plug has a reduced incidence of defectives produced as a result of breakage of the insulator upon press-insertion of the metallic terminal into the axial hole of the insulator.

In the spark plug of the present invention, the above-mentioned ratio (E/A) falls within a predetermined range. Therefore, the spark plug of the present invention is more excellent in load life performance.

In the spark plug of the present invention, the intermediate diameter portion diameter (B) is 3.2 mm or less, and the above-mentioned relational expressions (i) to (iv) are satisfied when the distance ((B−A)/2) is represented by X, and the ratio (E/A) is represented by Y. Therefore, the spark plug of the present invention is further more excellent in load life performance.

In the spark plug of the present invention, the length of the fixing portion in the direction of the axis falls within a predetermined range. Therefore, the spark plug of the present invention is excellent in the fixing strength of the metallic terminal to the insulator.

In the spark plug of the present invention, when the intermediate diameter portion diameter (B) is 2.9 mm or less, the load life performance and the fixing strength of the metallic terminal to the insulator are enhanced more effectively.

DETAILED DESCRIPTION OF PREFERRED EMBODIMENTS

Figure 1:
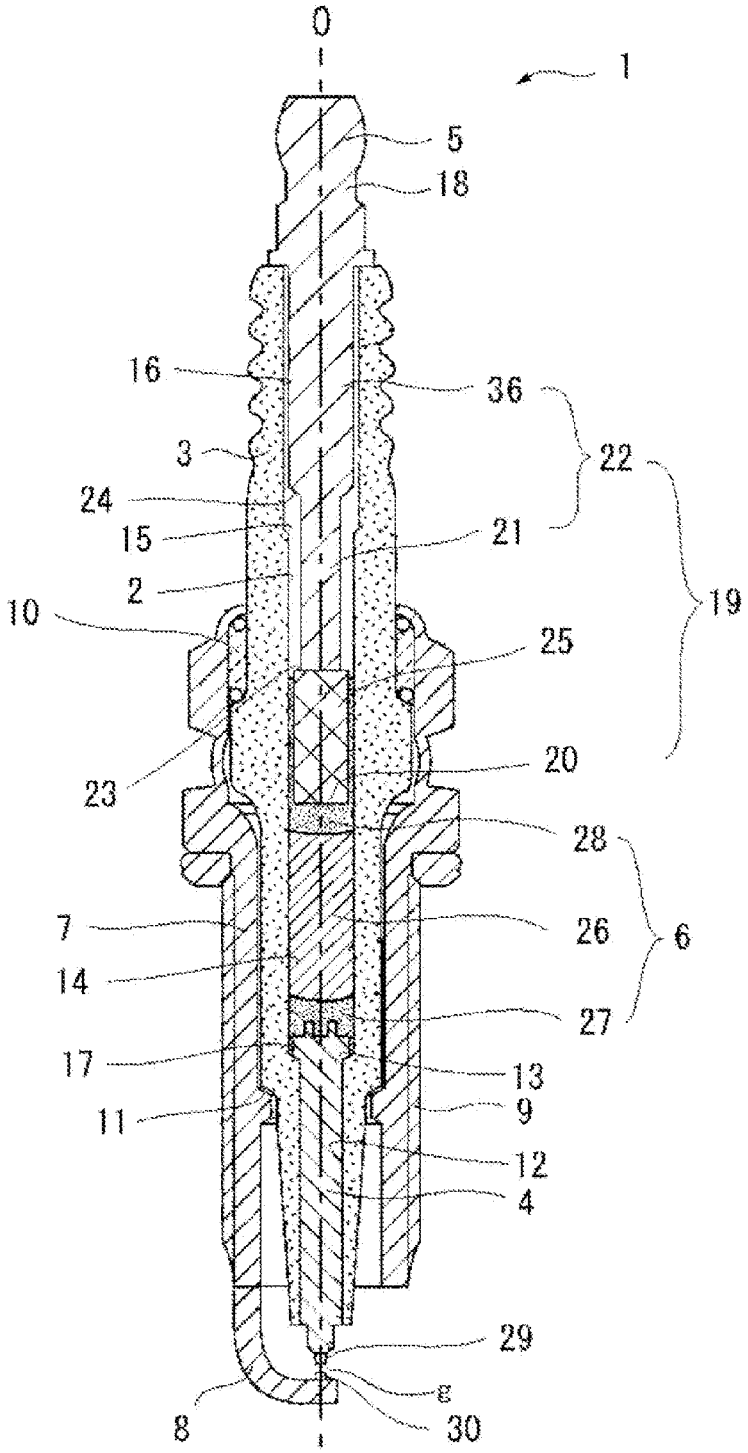
FIG. 1 is an explanatory view showing a cross section of a spark plug according to one embodiment of the present invention.

FIG. 1 shows a spark plug according to one embodiment of the present invention. FIG. 1 is an explanatory view showing a cross section of the entirety of a spark plug 1 which is one embodiment of the spark plug according to the present invention. In FIG. 1, the axis of an insulator is denoted by O. In the following description, the lower side of the sheet on which FIG. 1 is drawn will be referred to as the forward end side along the axis O, and the upper side of the sheet on which FIG. 1 is drawn will be referred to as the rear end side along the axis O.

This spark plug 1 includes an insulator 3 which has an axial hole 2 extending in the direction of the axis O. A center electrode 4 is held at the forward end side of the axial hole 2. A metallic terminal 5 is held at the rear end side of the axial hole 2. A connecting portion 6 electrically connects the center electrode 4 and the metallic terminal 5 within the axial hole 2. A metallic shell 7 accommodates the insulator. A ground electrode 8 has one end that is joined to a forward end surface of the metallic shell 7 and another end that faces the center electrode 4 with a gap formed therebetween.

The metallic shell 7 has a generally cylindrical shape and is formed to accommodate and hold the insulator 3. A threaded portion 9 is formed on the outer circumferential surface of a forward end portion of the metallic shell 7. The spark plug 1 is dimensioned to be attached to the cylinder head of an internal combustion engine (not shown) through use of the threaded portion 9. The metallic shell 7 may be formed of an electrically conductive steel material such as low-carbon steel. Preferably, the threaded portion 9 has a size of M12 or less in order to decrease the diameter thereof.

The insulator 3 is held inside the metallic shell 7 via talc 10, a packing 11, etc. The axial hole 2 of the insulator 3 has a small diameter portion 12 for holding the center electrode 4 on the forward end side along the axis O. An intermediate diameter portion 14 which accommodates the connecting portion 6 and which is greater in diameter than the small diameter portion 12, is located adjacent to the small diameter portion 12 via a first step portion 13. A large diameter portion 16, which is greater in diameter than the intermediate diameter portion 14, is located adjacent to the intermediate diameter portion 14 via a second step portion 15. The insulator 3 is fixed to the metallic shell 7 such that a forward end portion of the insulator 3 projects from the forward end surface of the metallic shell 7. The insulator 3 is preferably formed of a material which is sufficiently high in mechanical strength, thermal strength, electrical strength, etc. An example of such a material is a ceramic sintered body containing alumina as a main component.

The center electrode 4 is accommodated in the small diameter portion 12 of the axial hole 2, and a flange portion 17 provided at the rear end of the center electrode 4 and having a larger diameter is engaged with the first step portion 13 of the axial hole 2. Thus, the center electrode 4 is held such that the forward end of the center electrode 4 projects from the forward end surface of the insulator 3, and the center electrode 4 is insulated from the metallic shell 7. The center electrode 4 is preferably formed of a material having a sufficient thermal conductivity, a sufficient mechanical strength, etc. For example, the center electrode 4 is formed of a nickel alloy such as Inconel (trademark). A core portion of the center electrode 4 may be formed of a metallic material which is excellent in thermal conductivity, such as Cu or Ag.

The ground electrode 8 is formed into, for example, a generally prismatic shape. The ground electrode 8 is joined at its one end to the forward end surface of the metallic shell 7, and is bent in the middle to have a generally L-like shape. The shape and structure of the ground electrode 8 are designed such that its distal end portion faces a forward end portion of the center electrode 4 with a gap formed therebetween. The ground electrode 8 is formed of the same material as that of the center electrode 4.

Noble metal tips 29 and 30 formed of a platinum alloy, an iridium alloy, or the like may be respectively provided on the surfaces of the center electrode 4 and the ground electrode 8 which face each other. Alternatively, a noble metal tip may be provided on only one of the center electrode 4 and the ground electrode 8. In the spark plug 1 of the present embodiment, both the center electrode 4 and the ground electrode 8 have the noble metal tips 29 and 30 provided thereon, and a spark discharge gap g is formed between the noble metal tips 29 and 30.

The metallic terminal 5 is used to externally apply to the center electrode 4 a voltage for generating spark discharge between the center electrode 4 and the ground electrode 8. The metallic terminal 5 has a first constituent portion 18 and a second constituent portion 19. The first constituent portion 18 has a diameter greater than the diameter of the axial hole 2 and is exposed from the axial hole 2. A portion of the first constituent portion 18 butts against the end surface of the insulator 3 located on the rear end side with respect to the direction of the axis O. The second constituent portion 19 extends forward from the end surface of the first constituent portion 18 located on the forward end side with respect to the direction of the axis O, and is accommodated in the axial hole 2. The metallic terminal 5 is formed of, for example, low-carbon steel or the like, and a nickel layer is formed on the surface of the metallic terminal 5 through plating or the like.

The second constituent portion 19 in the present embodiment has a forward end portion 20 and a trunk portion 22. The forward end portion 20 is a portion of the second constituent portion 19 which extends rearward along the axis O from the forward end thereof by an amount of about 1 mm. The trunk portion 22 is located on the rear end side of the forward end portion 20 with respect to the direction of the axis O, and is located adjacent to the first constituent portion 18. As will be described later, the second constituent portion 19 has a fixing portion 25 which is provided at the forward end thereof with respect to the direction of the axis O and which has an uneven surface. A smallest diameter portion 21, which is a portion of the trunk portion 22 having the smallest diameter, is present on the rear end side of the fixing portion 25, and a larger diameter portion 36, which is larger in diameter than the smallest diameter portion 21, is present on the rear end side of the smallest diameter portion 21. The forward end portion 20 is accommodated in the intermediate diameter portion 14, and the larger diameter portion 36 is accommodated in the large diameter portion 16. In the spark plug 1 of the present embodiment, the fixing portion 25 (including the forward end portion 20), the smallest diameter portion 21, and the larger diameter portion 36 differ in diameter from one another. Therefore, a first step portion 23 is formed between the fixing portion 25 and the smallest diameter portion 21. A second step portion 24 is formed between the smallest diameter portion 21 and the larger diameter portion 36.

Figure 2A:
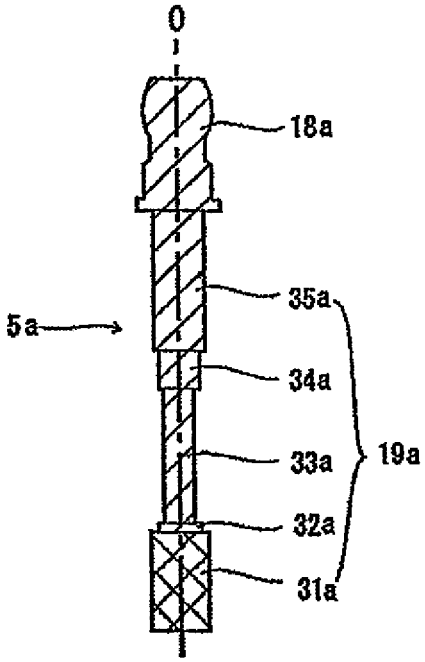
FIGS. 2(*a*) and 2(*b*) are explanatory views each showing a cross section of a metallic terminal which is one embodiment of the metallic terminal of the spark plug according to the present invention.
Figure 2B:
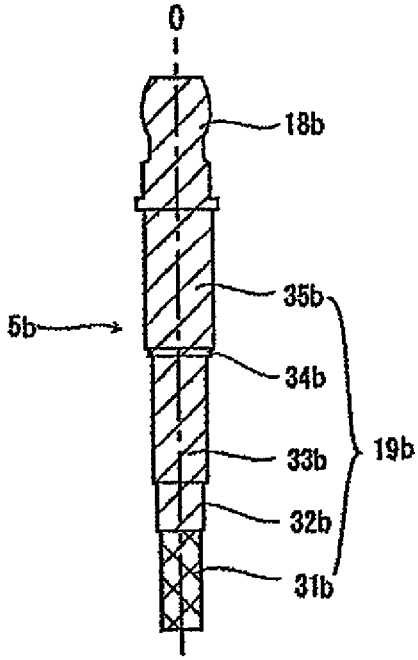

The second constituent portion 19 in the spark plug 1 of the present embodiment has the form of a multi-step circular column having three different diameters. However, the second constituent portion 19 may have the form of a circular column having a constant diameter, the form of a circular column having two different diameters, or the form of a circular column having four or more different diameters. For example, as shown in FIG. 2, the second constituent portion 19*a*, 19*b* may be composed of a plurality of circular columnar terminal portions (a first terminal portion 31*a*, 31*b* to a fifth terminal portion 35*a*, 35*b*) which are arranged in this sequence from the forward end side and which have different diameters. Specifically, as shown in FIG. 2(*a*), the second constituent portion may have a shape such that the diameter decreases stepwise from the forward end side, becomes the smallest at the third terminal portion 33*a*, and increases toward the rear end. Alternatively, the second constituent portion may have a shape such that the diameter increases stepwise from the forward end side, becomes the largest at the third terminal portion, and decreases toward the rear end (not shown). Also, as shown in FIG. 2(*b*), the second constituent portion may have a shape such that the diameter increases stepwise from the forward end side toward the rear end side. Alternatively, the second constituent portion may have a shape such that the diameter decreases stepwise from the forward end side toward the rear end side (not shown).

Also, in the present embodiment, the outer circumferential surface of the fixing portion 25 located near the forward end of the second constituent portion 19 is knurled. Since the surface of the second constituent portion 19 near the forward end thereof has an uneven structure formed by, for example, knurling, the degree of adhesion between the metallic terminal 5 and the connecting portion 6 increases. As a result, the metallic terminal 5 and the insulator 3 are firmly fixed together. Therefore, preferably, the second constituent portion 19 has the fixing portion 25 near the forward end of the second constituent portion 19 through which the second constituent portion 19 is in contact with the connecting portion 6.

The connecting portion 6 is disposed in the axial hole 2 such that it is located between the center electrode 4 and the metallic terminal 5, and electrically connects the center electrode 4 and the metallic terminal 5. The connecting portion 6 includes a resistor 26 and prevents generation of radio noise by the action of the resistor 26. In the present embodiment, the connecting portion 6 has a first seal layer 27 between the resistor 26 and the center electrode 4 and a second seal layer 28 between the resistor 26 and the metallic terminal 5. The first seal layer 27 and the second seal layer 28 fix the insulator 3, the center electrode 4, and the metallic terminal 5 in a sealed condition.

The resistor 26 may be constituted by a resistor member formed by sintering a resistor composition which contains powder of glass such as borosillicate soda glass, powder of ceramic such as $ZrO_2$, electrically conductive nonmetallic powder such as carbon black, and/or powder of metal such as Zn, Sb, Sn, Ag, Ni, etc. The resistor 26 typically has a resistance of 100 Ω or higher.

The first seal layer 27 and the second seal layer 28 may be constituted by a seal member which is formed by sintering a seal powder which contains powder of glass such as borosillicate soda glass and powder of metal such as Cu, Fe, etc. Each of the first seal layer 27 and the second seal layer 28 typically has a resistance of 100 mΩ or lower.

Notably, the connecting portion 6 may be formed by the resistor 26 only, without using the first seal layer 27 and the second seal layer 28. The connecting portion 6 may be formed by the resistor 26 and one of the first seal layer 27 and the second seal layer 28.

In the following description, the resistor member and/or the seal member constituting the connecting portion 6 may be collectively referred to as a connecting member, and the resistor composition and/or the seal powder used for forming the connecting portion 6 may be collectively referred to as connecting powder.

Figure 3:
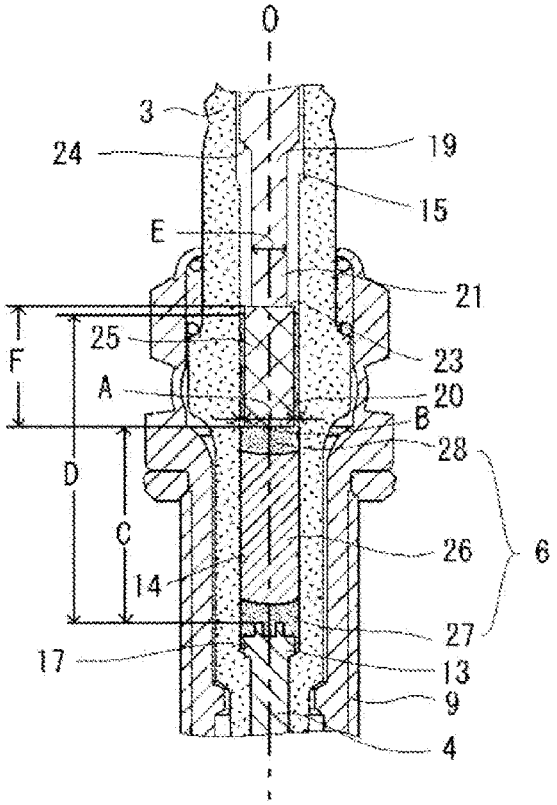
FIG. 3 is an explanatory view showing a cross section of a main portion of the spark plug which is one embodiment of the spark plug according to the present invention.

In the spark plug of the present invention, as shown in FIG. 3, the diameter of the forward end portion 20 of the second constituent portion 19 is referred to as a forward end portion diameter (A). The diameter of the intermediate diameter portion 14 is referred to as an intermediate diameter portion diameter (B). A length from the rear end of the center electrode 4 to the rear end of the connecting member which constitutes the connecting portion 6 is referred to as a charging length (D). A length from the rear end of the center electrode 4 to the forward end of the second constituent portion 19 is referred to as a connecting portion length (C). In such a case, the spark plug of the present invention satisfies the following conditions (1) to (3).

(1) the distance ((B−A)/2) between the forward end portion 20 of the second constituent portion 19 and the wall surface of the intermediate diameter portion 14 falls within a range of 0.02 mm to 0.2 mm, preferably, is 0.19 mm or less.

(2) the shrinkage amount (D−C) falls within a range of 6 mm to 27 mm.

(3) the Vickers hardness of the second constituent portion 19 at ordinary temperature falls within a range of 100 Hv to 430 Hv, preferably, within a range of 150 Hv to 350 Hv.

When the distance ((B−A)/2) of the condition (1) and the Vickers hardness of the condition (3) fall within the above-described ranges, bending and deformation of the second constituent portion 19 in the direction perpendicular to the axis O can be suppressed. If the metallic terminal 5 neither bends nor deforms excessively in a press step to be described later; i.e., when the metallic terminal 5 is press-inserted into the axial hole 2, its pressure can be effectively transferred to the resistor composition that constitutes the connecting portion 6. Thus, the resistor 26 can be formed such that the resistor 26 has a high density, and, as a result, a spark plug which is excellent in load life performance can be provided.

When the distance ((B−A)/2) of the condition (1) is small, the fixing strength of the insulator 3 to the metallic terminal 5 (hereinafter may be referred to as the terminal fixing strength) may decrease. However, when the shrinkage amount (D−C) of the condition (2) falls within the above-described range, a sufficiently large contract area is secured between the connecting member and the inner circumferential surface of the insulator 3 and between the connecting member and the outer circumferential surface of a portion of the second constituent portion 19 near the forward end thereof; for example, the outer circumferential surface of the fixing portion 25, whereby the fixing strength of the metallic terminal 5 to the insulator 3 becomes adequate. As a result, even when the spark plug receives vibration continuously, the metallic terminal 5 is prevented from vibrating or rattling within the axial hole 2.

Also, when the shrinkage amount (D−C) of the condition (2) falls within the above-described range, the resistor 26 can be formed to have a high density, because when the metallic terminal 5 is press-inserted into the axial hole 2 of the insulator 3, its pressure can be effectively transferred to the resistor composition.

When the distance ((B−A)/2) is less than 0.02 mm, the insertion of the metallic terminal 5 to the axial hole 2 becomes difficult in some cases, and the terminal fixing strength may decrease. When the distance ((B−A)/2) is greater than 0.2 mm, especially, greater than 0.19 mm, there arises a possibility that the resistor 26 cannot be formed to have a high density, because when the metallic terminal 5 is press-inserted into the axial hole 2 of the insulator 3, its pressure cannot be sufficiently transferred to the resistor composition.

When the above-described shrinkage amount (D−C) is less than 6 mm, the terminal fixing strength may become insufficient. Also, when the metallic terminal 5 is press-inserted into the axial hole 2 of the insulator 3, its pressure cannot be sufficiently transferred to the resistor composition. Therefore, there arises a possibility that the resistor 26 cannot be formed to have a high density, and the load life performance of the park plug becomes poor. When the above-described shrinkage amount (D−C) is greater than 27 mm, a high pressure is transferred to the resistor composition upon press-insertion of the metallic terminal 5 into the axial hole 2 of the insulator 3. Therefore, the insulator 3 becomes more likely to crack near the boundary between the intermediate diameter portion 14 and the small diameter portion 12, and defective incidence increases.

When the above-described Vickers hardness is less than 100 Hv, there arises a possibility that the resistor 26 cannot be formed to have a high density, because when the metallic terminal 5 is press-inserted into the axial hole 2 of the insulator 3, its pressure cannot be sufficiently transferred to the resistor composition. When the above-described Vickers hardness is greater than 430 Hv, a high pressure is transferred to the resistor composition upon press-insertion of the metallic terminal 5 into the axial hole 2 of the insulator 3. Therefore, the insulator 3 becomes more likely to crack near the boundary between the intermediate diameter portion 14 and the small diameter portion 12, and defective incidence increases.

In the spark plug of the present invention, preferably, a smallest diameter portion diameter (E), which is the diameter of the smallest diameter portion 21 of the second constituent portion 19 having the smallest diameter, satisfies the following condition (4).

(4) The ratio (E/A) of the smallest diameter portion diameter (E) to the forward end portion diameter (A) falls within a range of 0.85 to 1.16, preferably, within a range of 1.00 to 1.16.

The smallest diameter portion 21 is a portion of the trunk portion 22 which has the smallest diameter and a length of 1 mm or greater in the direction of the axis O. For example, in the metallic terminal 5*a* shown in FIG. 2(*a*), the smallest diameter portion is the third terminal portion 33*a*. In the metallic terminal 5*b* shown in FIG. 2(*b*), the smallest diameter portion is the first terminal portion 31*b*.

When the above-described ratio (E/A) of the condition (4) falls within the above-described range, the bending and deformation of the second constituent portion 19 in the direction perpendicular to the axis O can be suppressed further, and the spark plug become more excellent in terms of load life performance. Moreover, when the smallest diameter portion diameter (E) is greater than the forward end portion diameter (A); i.e., when the ratio (E/A) is greater than 1, the strength of the second constituent portion 19 increases, whereby the bending and deformation are suppressed. Moreover, the possibility that the insulator 3 cracks upon insertion of the insulator 3 into the axial hole 2 can be lowered. When the metallic terminal 5 has a diameter determined such that a proper gap is formed between the metallic terminal 5 and the wall surface of the axial hole 2, the metallic terminal 5 can be press-inserted into the axial hole 2 of the insulator 3 without cracking the insulator.

In the spark plug of the present invention, preferably, the intermediate diameter portion diameter (B) is equal to or less than 3.2 mm, and the following relational expressions (i) to (iv) are satisfied, where X represents the above-described distance ((B−A)/2), and Y represents the above-described ratio (E/A).

$$0.02 \leq X \leq 0.19 \quad \text{(i)}$$

$$Y \geq X + 0.8 \quad \text{(ii)}$$

$$Y \geq 0.85 \quad \text{(iii)}$$

$$Y \leq 1.06X + 0.96 \quad \text{(iv)}$$

Figure 4:
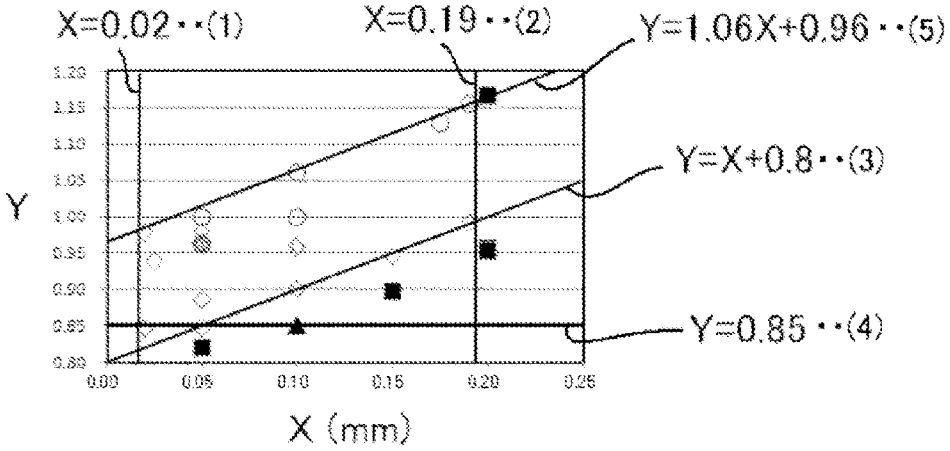
FIG. 4 is a graph showing the relation between the distance ((B−A)/2) and the ratio (E/A).

FIG. 4 is a graph in which the X-axis represents the above-described distance ((B−A)/2), and the Y-axis represents the above-described ratio (E/A). The graph shows straight lines corresponding to the above-described relational expressions (i) to (iv) when they become equalities. When the above-described relational expressions (i) to (iv) are satisfied, in FIG. 4, the combination of X and Y is located in a region surrounded by the straight lines (1) to (5).

When (i) $0.02 \leq X \leq 0.19$; i.e., when, in FIG. 4, X is located in a region between the straight line (1) and the straight line (2), as described above, the bending and deformation of the second constituent portion 19 in the direction perpendicular to the axis O can be suppressed further.

When X falls within the above-described region, and the above-described relational expression (ii) $Y \geq X+0.8$ and the above-described relational expression (iii) $Y \geq 0.85$ are satisfied; i.e., when, in FIG. 4, X is located in the region between the straight lines (1) and (2), and Y is located in a region above the straight lines (3) and (4), the bending and deformation of the second constituent portion 19 in the direction perpendicular to the axis O can be suppressed further. Y (i.e., the ratio (E/A)) is the ratio of the thickness of the thinnest portion of the trunk portion 22 to the thickness of the forward end portion of the metallic terminal, and X (i.e., the distance ((B−A)/2)) represents the gap between the forward end portion 20 and the wall surface of the axial hole 2. The difference in thickness (diameter) between the forward end portion 20 and the trunk portion 22 is determined such that the larger the gap between the forward end portion 20 and the wall surface of the axial hole 2, the smaller the difference in thickness. Thus, the bending and deformation of the second constituent portion 19 can be suppressed. Moreover, by rendering the trunk portion 22 thicker than the forward end portion 20, the strength of the second constituent portion 19 can be increased, whereby the bending and deformation of the second constituent portion 19 can be suppressed. However, although the bending and deformation of the second constituent portion 19 is suppressed by increasing the value of Y, a problem arises when the value of Y exceeds 1.0. Specifically, when the value of Y exceeds 1.0, the trunk portion 22 becomes thicker than the forward end portion 20. In such a case, even when the value of X, which represents the gap between the forward end portion 20 and the wall surface of the axial hole 2 can be maintained in the predetermined range, because of the thick trunk portion 22, the insulator 3 may crack when the metallic terminal 5 is inserted into the axial hole 2. Accordingly, preferably, the above-described relational expression (iv) $Y \leq 1.06X+0.96$ is satisfied; namely, in FIG. 4, the value of Y is located in a region below the straight line (5).

In the spark plug of the present invention, preferably, a fixing portion length (F), which is the length of the fixing portion 25 in the direction of the axis O, satisfies the following condition (5). (5) The fixing portion length (F) falls within a range of 3 mm to 25 mm.

When the fixing portion length (F) of the condition (5) falls within the above-described range, the terminal fixing strength increases further.

In the spark plug of the present invention, when the intermediate diameter portion diameter (B) is 2.9 mm or less, the load life performance and the terminal fixing strength can be enhanced more effectively.

Each of the above-described dimensions (A) to (F) can be obtained by photographing the spark plug from a direction perpendicular to the axis O using a fluoroscopic apparatus, and measuring the relevant portion. As shown in FIG. 3, the forward end portion diameter (A) is obtained by measuring the distance (in the direction perpendicular to the axis O) of the second constituent portion 19 at a position shifted 1 mm from the forward end of the second constituent portion 19 toward the rear end side along the axis O. The intermediate diameter portion diameter (B) is obtained by measuring the distance (in the direction perpendicular to the axis O) of the intermediate diameter portion 14 at that position. The connecting portion length (C) is obtained by measuring the length (in the direction of the axis O) from the rear end of the center electrode 4 to the forward end of the second constituent portion 19. The charging length (D) is obtained by measuring the length (in the direction of the axis O) from the rear end of the center electrode 4 to the rear end of the connecting member. The smallest diameter portion diameter (E) is obtained by measuring the distance (in the direction perpendicular to the axis O) at a portion of the second constituent portion 19 which is smallest in diameter and has a length of 1 mm or greater in the direction of the axis O. The fixing portion length (F) is obtained by measuring the length (in the direction of the axis O) of the uneven portion provided on the surface of the second constituent portion 19.

The seal member adhering to the inner circumferential surface of the axial hole 2 is observed on the rear end side of the second seal layer 28. A rearmost end portion (with respect to the direction of the axis O) of the seal member serves as the rear end of the seal member. As a result of application of a load and heat, seal powder charged in the axial hole 2 before a press step (to be described later) is compressed, so that the seal powder becomes the seal member which constitutes the second seal layer 28. Meanwhile, a portion of the seal powder adhering to the inner circumferential surface of the axial hole 2 remains as a seal member. Accordingly, the position of the rearmost end of the seal member with respect to the direction of the axis O is considered to be identical with the position of the rear end of the seal powder charged in the axial hole 2 before the press step. Therefore, the difference (D−C) between the charging length (D) and the connecting portion length (C) represents a shrinkage length by which the connecting portion 6 shrinks in the direction of the axis O in the press step.

Notably, in this embodiment, the connecting portion 6 includes the first seal layer 27, the resistor 26, and the second seal layer 28, which are disposed in this sequence from the forward end side with respect to the direction of the axis O. However, the embodiment may be modified such that the connecting portion 6 is formed by the resistor 26 only without using the first seal layer 27 and the second seal layer 28, the connecting portion 6 is formed by the resistor 26 and the first seal layer 27, or the connecting portion 6 is formed by the resistor 26 and the second seal layer 28. Accordingly, in the present embodiment, the substance which remains on and adheres to the inner circumferential surface of the axial hole 2 is the seal member which constitutes the second seal layer 28. However, in the case where the connecting portion 6 is formed by the first seal layer 27 and the resistor 26 without using the second seal layer 28, the resistor member which constitutes the resistor 26 is observed as a substance which remains on and adheres to the inner circumferential surface of the axial hole 2. In this case, the length (in the direction of the axis O) from the rear end of the center electrode 4 to the rearmost end of the resistor member with respect to the direction of the axis O is used as the charging length (D).

The Vickers hardness of the second constituent portion 19 at ordinary temperature can be obtained as follows. The second constituent portion 19 is cut along a plane perpendicular to the axis O at a position shifted from the forward end thereof by 2 mm. The thus-obtained cut surface is then polished, and hardness is measured at arbitrary five points on the polished surface in accordance with JISZ2244. The average of the measured harnesses is calculated, whereby the Vickers hardness of the second constituent portion 19 can be obtained. The Vickers hardness of the second constituent portion 19 at ordinary temperature can be adjusted, i.e., modified, by selecting the material of the metallic terminal, by changing the amount of carbon, and/or changing the heat treatment condition.

For example, the spark plug 1 is manufactured as follows.

First, the center electrode 4, the ground electrode 8, the metallic shell 7, the metallic terminal 5, and the insulator 3 are fabricated by known methods such that they have predetermined shapes (preparing step), and one end portion of the ground electrode 8 is joined to the forward end surface of the metallic shell 7 by laser welding or the like (ground electrode joining step).

Meanwhile, the center electrode 4 is inserted into the axial hole 2 of the insulator 3, and the flange portion 17 of the center electrode 4 is brought into engagement with the first step portion 13 of the axial hole 2, whereby the center electrode 4 is disposed in the small diameter portion 12 (center electrode disposing step).

Subsequently, a seal powder which forms the first seal layer 27, a resistor composition which forms the resistor 26, and a seal powder which forms the second seal layer 28 are placed in this sequence into the axial hole 2 from the rear end thereof. Subsequently, a press pin is inserted into the axial hole 2 so as to preliminarily compress them under a pressure of 60 $N/mm^2$ or greater. Thus, the seal powders and the resistor composition are charged into the intermediate diameter portion 14 (charging step).

Subsequently, the forward end portion 20 of the metallic terminal 5 is inserted into the axial hole 2 from the rear end thereof, and the metallic terminal 5 is disposed such that the forward end portion 20 comes into contact with the seal powder (disposing step).

Subsequently, the connecting powder is heated at a temperature equal to or higher than the glass softening point of the glass powder contained in the seal powders (e.g., 800° C. to 1000° C.) for 3 min to 30 min. In this heated state, the metallic terminal 5 is pressed and inserted until the forward end surface of the first constituent portion 18 of the metallic terminal 5 butts against the rear end surface of the insulator 3, whereby the seal powders and the resistor composition are compressed and heated (press step).

Thus, the seal powders and the resistor composition are sintered, whereby the resistor 26, the first seal layer, and the second seal layer are formed. At that time, in the spark plug which satisfies the above-described conditions (1) to (3), a pressure is effectively transferred from the metallic terminal 5 to the resistor composition. Therefore, the density of the resistor 26 becomes high.

Also, the seal member is charged into the gap between the flange portion 17 and the wall surface of the axial hole 2 and between the forward end portion 20 and the wall surface of the axial hole 2. Thus, the center electrode 4 and the metallic terminal 5 are fixedly disposed in the axial hole 2 in a sealed condition. At that time, in the spark plug 1 which satisfies the above-described condition (2), the seal member is adequately charged into the gap between the forward end portion 20 and the wall surface of the axial hole 2. Therefore, the spark plug 1 is excellent in terms of the fixing strength of the metallic terminal 5 to the insulator 3.

Next, the insulator 3 including the center electrode 4, the metallic terminal 5, etc., fixed thereto is assembled to the metallic shell 7 having the ground electrode 8 joined thereto (assembly step).

Finally, a distal end portion of the ground electrode 8 is bent toward the center electrode 4 such that the distal end of the ground electrode 8 faces the forward end portion of the center electrode 4. Thus, the spark plug 1 is completed.

The spark plug according to the present invention is used as an ignition plug for an internal combustion engine (e.g., a gasoline engine) for automobiles. The above-mentioned threaded portion 9 is screwed into a threaded hole provided in a head (not shown) which defines and forms combustion chambers of the internal combustion engine, whereby the spark plug is fixed at a predetermined position. Although the spark plug according to the present invention can be used for any internal combustion engine, the spark plug is favorably used for an internal combustion engine in which the space for spark plugs is reduced. In this respect, the present invention provides a remarkable effect when it is applied to spark plugs having a reduced diameter.

The spark plug of the present invention is not limited to the above-described embodiment, and various modifications are possible within a range in which the object of the present invention can be achieved. For example, the above-described spark plug 1 has the knurled fixing portion 25 near the forward end of the metallic terminal 5. However, no particular limitation is imposed on the method of processing the surface of the fixing portion so long as the surface of the fixing portion has a shape (e.g., an uneven shape) which enhances the adhesion between the fixing portion and the seal member. For example, the surface of the fixing portion 25 may have a shape formed by threading or the like. Also, the entire outer circumferential surface of the fixing portion 25 may have an uneven shape or a portion of the surface may have an uneven shape.

Since the spark plug of the present invention satisfies the above-described requirements (1) to (3), especially the above-described requirements (1) to (5), irrespective of the length (in the direction of the axis) and diameter of the first constituent portion, the spark plug is excellent in load life performance and the fixing strength of the metallic terminal to the insulator, and has a reduced incidence of defectives produced as a result of breakage of the insulator upon press-insertion of the metallic terminal into the axial hole of the insulator.

EXAMPLES

Manufacture of Spark Plug

The spark plug shown in FIG. 1 was manufactured in accordance with the above-described manufacturing process. Spark plugs having various dimensions shown in Table 1 were manufactured by changing the forward portion diameter (A), the smallest diameter portion diameter (E), the fixing portion length (F), the intermediate diameter portion diameter (B), the connecting portion length (C), and the charging length (D).

The above-mentioned various dimensions were measured through use of a fluoroscopic apparatus.

Notably, the metallic terminal was manufactured through use of low-carbon steel, and the Vickers hardness was changed by adjusting the component of the metallic terminal. As described above, the Vickers hardness of the second constituent portion at ordinary temperature was measured in accordance with JISZ2244.

Evaluation Method

Load Life Performance Test

Each of the manufactured spark plugs was placed in an environment of 350° C., and a discharge voltage of 20 kV was applied thereto so as to generate discharge 3600 times over 1 min. The resistance $R_0$ of the resistor of each spark plug before this test and the resistance $R_1$ of the resistor after this test were measured. This test was carried out 10 times, and the time at which the ratio ($R_1/R_0$) of the average of the resistances $R_1$ after the test to the initial resistance $R_0$ become 1.5 or greater was measured. In consideration of the fact that the longer the above-mentioned time, the better the load life performance, the manufactured spark plugs were evaluated in accordance with the following criteria. The results of the evaluation are shown in Table 2.

1: shorter than 150 hours

2: 150 hours or longer but shorter than 200 hours 3 to 9: longer than 200 hours (after 200 hours, 1 point was added every 50 hours)

10: 550 hours or longer

Terminal Fixing Strength Test

The first constituent portion of the metallic terminal was clamped by a jig, and this jig was pulled by an autograph. The strength at which the metallic terminal was removed from the insulator was measured. The terminal fixing strength was evaluated in accordance with the following criteria. The evaluation results are shown in Table 2.

1: less than 2500 N

5: not less than 2500 N but less than 3500 N

10: not less than 3500 N, or the metallic terminal was broken

Evaluation of the Incidence of Defectives Caused by Insulator Breakage

When 20 spark plugs of each sample number were manufactured, the ratio of the number of spark plugs evaluated defective due to breakage of the insulator during the manufacturing steps was evaluated in accordance with the following criteria. The evaluation results are shown in Table 2.

1: 30% or greater

5: not less than 5% but less than 30%

10: less than 5%

Notably, the overall judgment in Table 2 was performed in accordance with the following criteria:

C: when an evaluation score is lower than 5 for any of the above-described three evaluation items;

B: when the evaluation score for any one of the above-described three evaluation items is 5, and the evaluation scores for the remaining evaluation items are 5 or higher;

A: when all the evaluation scores for the above-described three evaluation items are higher than 5 but not all the evaluation scores are 10; and AA: when all the evaluation scores for the above-described three evaluation items are 10.

TABLE 1

| | | Dimensions of metallic terminal | | | Dimension of insulator | | | | |
|---|---|---|---|---|---|---|---|---|---|
| Sample No. | | Forward end portion diameter A (mm) | Smallest diameter portion diameter E (mm) | Fixing portion length F (mm) | Intermediate-diameter portion diameter B (mm) | (B − A)/2 (mm) | E/A | Shrinkage amount D-C (mm) | Vickers hardness (Hv) |
| 1 | Comparative Example | 2.68 | 2.60 | 8 | 2.7 | 0.01 | 0.97 | 11 | 260 |
| 2 | Example | 2.66 | 2.60 | 8 | 2.7 | 0.02 | 0.98 | 11 | 260 |
| 3 | | 2.60 | 2.50 | 8 | 2.7 | 0.05 | 0.96 | 11 | 260 |
| 4 | | 2.50 | 2.40 | 8 | 2.7 | 0.1 | 0.96 | 11 | 260 |
| 5 | | 2.30 | 2.20 | 8 | 2.7 | 0.2 | 0.96 | 11 | 260 |
| 6 | Comparative Example | 2.20 | 2.10 | 8 | 2.7 | 0.25 | 0.95 | 11 | 260 |
| 7 | Example | 2.60 | 2.60 | 8 | 2.7 | 0.05 | 1.00 | 11 | 260 |
| 8 | | 2.60 | 2.30 | 8 | 2.7 | 0.05 | 0.88 | 11 | 260 |
| 9 | | 2.60 | 2.20 | 8 | 2.7 | 0.05 | 0.85 | 11 | 260 |
| 10 | | 2.60 | 2.13 | 8 | 2.7 | 0.05 | 0.82 | 11 | 260 |
| 11 | | 2.50 | 2.65 | 8 | 2.7 | 0.1 | 1.06 | 11 | 260 |
| 12 | | 2.35 | 2.65 | 8 | 2.7 | 0.175 | 1.13 | 11 | 260 |
| 13 | | 2.12 | 2.45 | 8 | 2.5 | 0.19 | 1.16 | 11 | 260 |
| 14 | | 2.10 | 2.45 | 8 | 2.5 | 0.2 | 1.17 | 11 | 260 |
| 15 | | 2.70 | 2.70 | 8 | 2.9 | 0.1 | 1.00 | 11 | 260 |
| 16 | Comparative Example | 2.60 | 2.50 | 8 | 2.7 | 0.05 | 0.96 | 11 | 70 |
| 17 | Example | 2.60 | 2.50 | 8 | 2.7 | 0.05 | 0.96 | 11 | 100 |
| 18 | | 2.60 | 2.50 | 8 | 2.7 | 0.05 | 0.96 | 11 | 150 |
| 19 | | 2.60 | 2.50 | 8 | 2.7 | 0.05 | 0.96 | 11 | 350 |
| 20 | | 2.60 | 2.50 | 8 | 2.7 | 0.05 | 0.96 | 11 | 430 |
| 21 | Comparative Example | 2.60 | 2.50 | 8 | 2.7 | 0.05 | 0.96 | 11 | 480 |
| 22 | Example | 2.60 | 2.50 | 2 | 2.7 | 0.05 | 0.96 | 11 | 260 |
| 23 | | 2.60 | 2.50 | 3 | 2.7 | 0.05 | 0.96 | 11 | 260 |
| 24 | | 2.60 | 2.50 | 25 | 2.7 | 0.05 | 0.96 | 11 | 260 |
| 25 | | 2.60 | 2.50 | 8 | 2.7 | 0.05 | 0.96 | 7 | 260 |
| 26 | | 2.60 | 2.50 | 8 | 2.7 | 0.05 | 0.96 | 6 | 260 |
| 27 | Comparative Example | 2.60 | 2.50 | 8 | 2.7 | 0.05 | 0.96 | 5 | 260 |
| 28 | Example | 2.60 | 2.50 | 8 | 2.7 | 0.05 | 0.96 | 27 | 260 |
| 29 | Comparative | 2.60 | 2.50 | 8 | 2.7 | 0.05 | 0.96 | 28 | 260 |
| 30 | Example | 3.00 | 2.75 | 8 | 3.5 | 0.25 | 0.92 | 11 | 260 |
| 31 | Example | 3.30 | 2.80 | 8 | 3.5 | 0.1 | 0.85 | 11 | 260 |
| 32 | Comparative Example | 2.40 | 2.30 | 8 | 2.9 | 0.25 | 0.96 | 11 | 260 |
| 33 | Example | 2.40 | 2.35 | 8 | 2.5 | 0.05 | 0.98 | 7 | 260 |
| 34 | | 2.45 | 2.30 | 8 | 2.5 | 0.025 | 0.94 | 11 | 260 |
| 35 | | 2.40 | 2.30 | 8 | 2.5 | 0.05 | 0.96 | 11 | 260 |
| 36 | | 2.30 | 2.20 | 8 | 2.5 | 0.1 | 0.96 | 11 | 260 |

TABLE 1-continued

| Sample No. | Dimensions of metallic terminal: Forward end portion diameter A (mm) | Smallest diameter portion diameter E (mm) | Fixing portion length F (mm) | Dimension of insulator: Intermediate-diameter portion diameter B (mm) | (B − A)/2 (mm) | E/A | Shrinkage amount D-C (mm) | Vickers hardness (Hv) |
|---|---|---|---|---|---|---|---|---|
| 37 | 2.10 | 2.00 | 8 | 2.5 | 0.2 | 0.95 | 11 | 260 |
| 38 | 2.50 | 2.25 | 8 | 2.7 | 0.10 | 0.90 | 11 | 260 |
| 39 | 2.40 | 2.27 | 8 | 2.7 | 0.15 | 0.95 | 11 | 260 |
| 40 | 2.32 | 2.30 | 8 | 2.7 | 0.19 | 0.99 | 11 | 260 |
| 41 | 2.66 | 2.25 | 8 | 2.7 | 0.02 | 0.85 | 11 | 260 |
| 42 | 2.66 | 2.25 | 8 | 2.7 | 0.02 | 0.85 | 11 | 260 |
| 43 | 2.40 | 2.15 | 8 | 2.7 | 0.15 | 0.90 | 11 | 260 |
| 44 | 3.00 | 2.55 | 8 | 3.2 | 0.10 | 0.85 | 11 | 260 |
| 45 | 3.00 | 2.70 | 8 | 3.2 | 0.10 | 0.90 | 11 | 260 |

TABLE 2

| Sample No. | | Evaluation results: Defective incidence | Load life performance | Terminal fixing strength | Overall judgment |
|---|---|---|---|---|---|
| 1 | Comparative Example | 5 | 8 | 1 | C |
| 2 | Example | 10 | 8 | 10 | A |
| 3 | | 10 | 8 | 10 | A |
| 4 | | 10 | 8 | 10 | A |
| 5 | | 10 | 5 | 10 | B |
| 6 | Comparative Example | 10 | 1 | 10 | C |
| 7 | Example | 10 | 10 | 10 | AA |
| 8 | | 10 | 8 | 10 | A |
| 9 | | 10 | 8 | 10 | A |
| 10 | | 10 | 5 | 10 | B |
| 11 | | 10 | 10 | 10 | AA |
| 12 | | 10 | 10 | 10 | AA |
| 13 | | 10 | 10 | 10 | AA |
| 14 | | 10 | 5 | 10 | B |
| 15 | | 10 | 10 | 10 | AA |
| 16 | Comparative Example | 1 | 7 | 10 | C |
| 17 | Example | 5 | 7 | 10 | B |
| 18 | | 10 | 8 | 10 | A |
| 19 | | 10 | 8 | 10 | A |
| 20 | | 5 | 8 | 10 | B |
| 21 | Comparative Example | 1 | 10 | 10 | C |
| 22 | Example | 10 | 8 | 5 | B |
| 23 | | 10 | 8 | 10 | A |
| 24 | | 10 | 8 | 10 | A |
| 25 | | 10 | 8 | 10 | A |
| 26 | | 10 | 8 | 5 | B |
| 27 | Comparative Example | 10 | 1 | 1 | C |
| 28 | Example | 5 | 8 | 10 | B |
| 29 | Comparative | 1 | 8 | 10 | C |
| 30 | Example | 10 | 3 | 10 | C |
| 31 | Example | 10 | 9 | 10 | AA |
| 32 | Comparative Example | 10 | 1 | 10 | C |
| 33 | Example | 10 | 8 | 10 | A |
| 34 | | 10 | 8 | 10 | A |
| 35 | | 10 | 8 | 10 | A |
| 36 | | 10 | 8 | 10 | A |
| 37 | | 10 | 5 | 10 | B |
| 38 | | 10 | 8 | 10 | A |
| 39 | | 10 | 8 | 10 | A |
| 40 | | 10 | 8 | 10 | A |
| 41 | | 10 | 8 | 10 | A |
| 42 | | 10 | 8 | 10 | A |
| 43 | | 10 | 5 | 10 | A |

TABLE 2-continued

| Sample No. | Evaluation results: Defective incidence | Load life performance | Terminal fixing strength | Overall judgment |
|---|---|---|---|---|
| 44 | 10 | 6 | 10 | A |
| 45 | 10 | 8 | 10 | A |

As shown in Table 2, the spark plugs falling within the range of the present invention were excellent in load life performance and terminal fixing strength, and were in low in the incidence of defectives produced as a result of breakage of the insulator. In contrast, the spark plugs falling outside the range of the present invention were poor in at least one of load life performance, terminal fixing strength, and defective incidence.

The spark plug of sample No. 1 in which the distance ((B−A)/2) was less than 0.02 mm was inferior in terminal fixing strength to the spark plugs falling within the range of the present invention. The spark plugs of samples No. 6, 30, and 32 in which the distance ((B−A)/2) was greater than 0.2 mm were inferior in load life performance to the spark plugs falling within the range of the present invention. The spark plug of sample No. 27 in which the shrinkage amount (D−C) was less than 6 mm was inferior in both of load life performance and terminal fixing strength to the spark plugs falling within the range of the present invention. The spark plug of sample No. 29 in which the shrinkage amount (D−C) was greater than 27 mm was high in the incidence of defectives produced as a result of breakage of the insulator. The spark plug of sample No. 16 in which the Vickers hardness of the metallic terminal was smaller than 100 Hv was high in the incidence of defectives produced as a result of breakage of the insulator as compared with the spark plugs falling within the range of the present invention. The spark plug of sample No. 21 in which the Vickers hardness of the metallic terminal was greater than 430 Hv was high in the incidence of defectives produced as a result of breakage of the insulator as compared with the spark plugs falling within the range of the present invention.

For each of the samples whose overall judgments were "B," "A," or "AA," the distance ((B−A)/2) and the ratio (E/A) were plotted on a graph as the values of X and Y, respectively. FIG. 4 shows the relation between the distance ((B−A)/2) and the ratio (E/A). In FIG. 4, the results of the evaluation of the load life performance shown in Table 2 were classified in accordance with the following criteria, and were represented by different types of symbols.

White circle: the score for load life performance is 10.

White rhombus: the score for load life performance is 8.

Asterisk: the score for the load life performance is 7.

Black triangle: the score for load life performance is 6.

Black square: the score for load life performance is 5.

In FIG. 4, straight lines were drawn such that the symbols of "White circle," "White rhombus," and "Asterisk" (the score for load life performance is 7 or greater) are surrounded by the straight lines. As a result, the following five relational expressions were obtained.

$$X \geq 0.02 \quad (1)$$

$$X \leq 0.19 \quad (2)$$

$$Y \geq X+0.8 \quad (3)$$

$$Y \geq 0.85 \quad (4)$$

$$Y \leq 1.06X+0.96 \quad (5)$$

As shown FIG. 4, the samples whose X and Y values were located within the region surrounded by the lines represented by the relational expressions (1) to (5) were more excellent in load life performance.

Having described the invention, the following is claimed:

1. A spark plug comprising:

an insulator having an axial hole extending in a direction of an axis;

a center electrode held at one end of the axial hole;

a metallic terminal held at the other end of the axial hole; and a connecting portion which electrically connects the center electrode and the metallic terminal within the axial hole, the spark plug being characterized in that the metallic terminal has a first constituent portion exposed from the axial hole, and a second constituent portion accommodated in the axial hole;

the side of the metallic terminal where the first constituent portion is provided is defined as the rear end side with respect to the direction of the axis O;

the axial hole has an intermediate diameter portion in which a forward end portion of the second constituent portion is disposed; and when a diameter of the forward end portion of the second constituent portion is referred to as a forward end portion diameter (A), a diameter of the intermediate diameter portion is referred to as an intermediate diameter portion diameter (B), a length from the rear end of the center electrode to the rear end of a connecting member constituting the connecting portion is referred to as a charging length (D), and a length from the rear end of the center electrode to the forward end of the second constituent portion is referred to as a connecting portion length (C), a distance ((B−A)/2) between the forward end portion of the second constituent portion and the wall surface of the intermediate diameter portion falls within a range of 0.02 mm to 0.2 mm, a shrinkage amount (D−C) falls within a range of 6 mm to 27 mm, and the second constituent portion has a Vickers hardness of 100 Hv to 430 Hv at ordinary temperature.

2. A spark plug according to claim 1, wherein the second constituent portion has a smallest diameter portion, which is smallest in diameter, at a position other than the forward end portion of the second constituent portion; and a ratio (E/A) of a smallest diameter portion diameter (E), which is the diameter of the smallest diameter portion, to the forward end portion diameter (A), falls within a range of 0.85 to 1.16.

3. A spark plug according to claim 1, wherein the intermediate diameter portion diameter (B) is equal to or less than 3.2 mm, and the following relational expressions (i) to (iv) are satisfied, where X represents the distance ((B−A)/2), and Y represents the ratio (E/A):

$$X \leq 0.19, \quad (i)$$

$$Y \geq X+0.8, \quad (ii)$$

$$Y \geq 0.85, \text{ and} \quad (iii)$$

$$Y \leq 1.06X+0.96 \quad (iv).$$

4. A spark plug according to claim 2, wherein the ratio (E/A) falls within a range of 1.00 to 1.16.

5. A spark plug according to claim 1, wherein the intermediate diameter portion diameter (B) is 2.9 mm or less.

6. A spark plug according to claim 1, wherein the Vickers hardness of the second constituent portion at ordinary temperature falls within a range of 150 Hv to 350 Hv.

7. A spark plug according to claim 2, wherein the second constituent portion has a fixing portion having an uneven surface, and the fixing portion has a length of 3 mm to 25 mm in the direction of the axis O.

* * * * *